US011541271B2

(12) United States Patent
Cotton

(10) Patent No.: US 11,541,271 B2
(45) Date of Patent: Jan. 3, 2023

(54) MULTI-FUNCTIONAL EXERCISE DEVICE

(71) Applicant: C. John Cotton, Gillette, WY (US)

(72) Inventor: C. John Cotton, Gillette, WY (US)

( * ) Notice: Subject to any disclaimer, the term of this patent is extended or adjusted under 35 U.S.C. 154(b) by 0 days.

(21) Appl. No.: 17/481,107

(22) Filed: Sep. 21, 2021

(65) Prior Publication Data

US 2022/0001230 A1 Jan. 6, 2022

Related U.S. Application Data

(62) Division of application No. 16/662,885, filed on Oct. 24, 2019, now Pat. No. 11,305,148.

(51) Int. Cl.
*A63B 21/00* (2006.01)

(52) U.S. Cl.
CPC ..... *A63B 21/4035* (2015.10)

(58) Field of Classification Search
CPC ..... A63B 21/00047; A63B 21/0005; A63B 21/00054; A63B 21/068; A63B 21/4027; A63B 21/4033; A63B 21/4035; A63B 21/4049; A63B 22/20; A63B 22/201; A63B 22/203; A63B 23/035; A63B 23/03508; A63B 23/03516; A63B 23/12; A63B 23/1209; A63B 23/1236; A63B 2208/0295
See application file for complete search history.

(56) References Cited

U.S. PATENT DOCUMENTS 2,774,265 A 12/1956 Foner
2,987,087 A 6/1961 Norman et al.
3,512,563 A 5/1970 Sorensen
3,664,667 A * 5/1972 McCarthy ..... A63B 21/0552 482/131
3,717,431 A 2/1973 Matsuda
3,862,765 A 1/1975 Goheen
4,892,305 A 1/1990 Lynch
(Continued)

FOREIGN PATENT DOCUMENTS

KR 20100000660 U 1/2010

OTHER PUBLICATIONS

Amazon Sales Page for "it—Push up bars+Balance+Stretch ( Set of 2) / Prodigy Fit" located at https://www.amazon.com/dp/B013J42BFU/ref=sspa_dk_detail_3?psc=1&pd_rd_i=B013J42BFU.
(Continued)

*Primary Examiner* — Gary D Urbiel Goldner
(74) *Attorney, Agent, or Firm* — Corner Counsel, LLC

(57) ABSTRACT

A multi-functional exercise device that enables a user to exercise different muscle groups. The exercise device has a first planar support member, a second planar support member extending from the first planar support member, and a handle having a first end coupled to the first planar support member, a second end coupled to the second planar support member, and a gripping portion therebetween. The gripping portion of the handle is oriented generally parallel to the first planar support member and generally perpendicular to the second planar support member. The exercise device also includes a first plurality of rotatable components engaging the first planar support member and adapted to rotate relative thereto, and a second plurality of rotatable components engaging the second planar support member and adapted to rotate relative thereto. The rotatable elements may comprise spheres.

20 Claims, 7 Drawing Sheets

(56) References Cited

U.S. PATENT DOCUMENTS

| | | | | |
|---|---|---|---|---|
| 5,404,679 | A | 4/1995 | Friel et al. | |
| 5,522,629 | A | 6/1996 | Loo | |
| 6,942,605 | B1 | 9/2005 | Sukhovitsky | |
| 7,207,122 | B1 | 4/2007 | Ellis | |
| 7,585,262 | B1 | 9/2009 | Vayntraub | |
| 7,621,858 | B2 | 11/2009 | Sheron | |
| 8,241,189 | B2 | 8/2012 | Kanaoka | |
| 8,308,668 | B1 | 11/2012 | Harvat | |
| 8,702,574 | B2 | 4/2014 | Abranchess | |
| 8,814,758 | B1 | 8/2014 | Mattox | |
| 9,199,117 | B1 | 12/2015 | Nicholas | |
| 9,358,419 | B1 | 6/2016 | Smith | |
| 9,504,866 | B2 | 11/2016 | Peralo | |
| 9,511,250 | B2 | 12/2016 | Neal | |
| 9,623,273 | B1 | 4/2017 | Chen | |
| 9,750,975 | B2 | 9/2017 | Hunter, Jr. | |
| 9,993,679 | B2 | 6/2018 | Ressler, III | |
| 10,398,930 | B2 | 9/2019 | Chessen et al. | |
| 10,857,422 | B2 | 12/2020 | Okubadejo | |
| 11,045,683 | B2 | 6/2021 | Fuzell-Casey et al. | |
| 11,305,148 | B2 * | 4/2022 | Cotton | A63B 23/1236 |
| 2005/0250626 | A1 | 11/2005 | Charnitski | |
| 2008/0070762 | A1 | 3/2008 | White | |
| 2008/0090496 | A1 | 4/2008 | Santucci | |
| 2009/0023563 | A1 | 1/2009 | Liang | |
| 2009/0298656 | A1 | 12/2009 | Dannenberg | |
| 2010/0004105 | A1 | 1/2010 | Peddar | |
| 2010/0022365 | A1 | 1/2010 | Ngu | |
| 2010/0317496 | A1 | 12/2010 | Abranchess | |
| 2011/0166006 | A1 | 7/2011 | Howard | |
| 2012/0083396 | A1 | 4/2012 | Aquino | |
| 2012/0083397 | A1 * | 4/2012 | Meininger | A63B 23/03541 482/132 |
| 2012/0129653 | A1 | 5/2012 | Shalev et al. | |
| 2013/0210577 | A1 | 8/2013 | Ceoldo et al. | |
| 2013/0217549 | A1 | 8/2013 | Marji | |
| 2013/0252791 | A1 | 9/2013 | Chang | |
| 2013/0260970 | A1 * | 10/2013 | Moskowich | A63B 23/03541 482/141 |
| 2013/0274078 | A1 | 10/2013 | Andrews | |
| 2014/0100090 | A1 | 4/2014 | Lima et al. | |
| 2015/0126340 | A1 | 5/2015 | White | |
| 2015/0190668 | A1 | 7/2015 | Ferdinandsen, II | |
| 2016/0175644 | A1 | 6/2016 | Agostini | |
| 2018/0361191 | A1 | 12/2018 | Zachariadis | |
| 2019/0191954 | A1 | 6/2019 | Kamody et al. | |
| 2021/0121732 | A1 * | 4/2021 | Cotton | A63B 23/1236 |

OTHER PUBLICATIONS

Amazon Sales Page for "MetaBall Portable Push Up Handles Bars for Men Fitness Workout Push-up Handle Stands Green" located at https://www.amazon.com/dp/B07HRJGHGG/ref=sspa_dk_detail_0?psc=1&pd_rd_i=B07HRJGHGG.

Amazon Sales Page for "Garage Fit Steel Parallettes for Gymnastics, Handstand Push up Bars, Dip Bars, Push up Stand" located at https://www.amazon.com/dp/B07P61444H/ref=sspa_dk_detail_2?psc=1&pd_rd_i=B07P61444H.

Amazon Sales Page for "Kegto Push Up Bars Foldable Push-up Bar Stands Slip Resistance with Padded Handles, Great for upper body Push Ups Workout, Muscle & Strength Training, One Pair" located at https://www.amazon.com/Kegto-Foldable-Slip-Resistance-Strength-Training/dp/B07BMZ8KCT/ref=pd_cp_200_4?pd_rd_w=kDkul&pf_rd_p=ef4dc990-%E2%80%A61/7.

The Spyder 360™, accessed and printed on Sep. 7, 2021 from website: https://thespyder360.com (13 pages).

The Spyder 360™, The Way Back Machine, accessed and printed on Sep. 21, 2021 from http://web.archive.org/web/20180819171006/https:/thespyder360.com (12 pages).

* cited by examiner

MULTI-FUNCTIONAL EXERCISE DEVICE

RELATED APPLICATION

This application is a divisional of U.S. patent application Ser. No. 16/662,885, filed Oct. 24, 2019, which is incorporated herein by reference in its entirety.

FIELD OF INVENTION

The invention relates to exercise devices and, more particularly, to devices capable of multi-functional use through placement in various orientations.

BACKGROUND

Prior art translatable (i.e., slidable, rollable, etc.) portable body weight exercise devices for the upper body and core allow for exercise of the muscles of the upper body in a limited range of motion and associated development of limited muscle groups. Prior art devices generally provide for primarily exercising the muscles of the chest (pectoralis major) and the core/abdomen with the hands in a pronated (palms down) position.

Accordingly, use of prior art translatable exercise devices may result in imbalanced muscle group development that adversely affects flexibility, strength, appearance and functionality, and also contributes to injury.

Presently, there are believed to be no suitable translatable multi-orientation portable body weight exercise devices for the upper body and core that are safe, easy-to-use, and allow for exercise of virtually all of the muscles of the upper body in multiple ranges of motion, with the hands in supinated (palms up) as well as pronated (palms down) positions, and with associated full rotation and full movement of shoulders and arms, and development of multiple muscle groups, for example, the chest, shoulders, arms, back, abdomen/core and others including, but not limited to, the trapezius, subclavius, deltoids, pectoralis minor, pectoralis major, serratus major, latissimus dorsi, rhomboids, infraspinatus, teres groups, and erector spinae. Thus, an exercise device capable of being utilized in more than one orientation is desirable so as to improve the development of multiple muscle groups.

SUMMARY

Embodiments of the present invention seek to provide solutions to the deficiencies identified above by providing multi-directional moving exercise devices allowing for exercise of virtually all of the muscles of a user's upper body in multiple ranges of motion, and associated development of multiple muscle groups by the user.

An embodiment of the invention includes an exercise device comprising a first planar support member; a second planar support member extending generally perpendicularly from the first planar support member; a handle having a first end coupled to the first planar support member, a second end coupled to the second planar support member, and a gripping portion therebetween, the gripping portion oriented generally parallel to the first planar support member and generally perpendicular to the second planar support member; a first plurality of rotatable components engaging the first planar support member and adapted to rotate relative thereto; and a second plurality of rotatable components engaging the second planar support member and adapted to rotate relative thereto.

Another embodiment of the invention includes an exercise device comprising a first planar support member having a first plurality of rotatable components adapted to rotate relative to the first planar support member; a second planar support member extending from the first planar support member at an angle alpha therebetween and having a second plurality of rotatable components adapted to rotate relative to the second planar support member; and a handle coupled to the first planar support member and to the second planar support member, the handle having an elongated gripping portion that contacts the second planar support member at one end of the handle, a support portion that contacts the first planar support member at the other end of the handle, and a curved connecting portion that extends between the gripping portion and the support portion; wherein the elongated gripping portion oriented generally parallel to the first planar support member and generally perpendicular to the second planar support member; wherein the exercise device is configured to be alternated between a first orientation in which the first planar support member is positioned against a surface, and a second orientation in which the second planar support member is positioned against the surface.

Yet another embodiment of the invention includes an exercise device comprising a first planar support member adapted to engage a surface in a first orientation; a second planar support member extending from the first planar support member at an angle alpha therebetween, and adapted to engage the surface in a second orientation; a first plurality of rotatable components engaging the first planar support member and adapted to rotate relative thereto; a second plurality of rotatable components engaging the second planar support member and adapted to rotate relative thereto; a handle coupled to the first planar support member and to the second planar support member, the handle having an elongated gripping portion that contacts the second planar support member at one end of the handle, a support portion that contacts the first planar support member at the other end of the handle, and a curved connecting portion that extends between the gripping portion and the support portion; wherein the exercise device further comprises a periphery that extends around the first planar support member and the second planar support member; and wherein the first planar support member includes a first surface-engaging face and a first chamfer that extends between the periphery and the first surface-engaging face.

DETAILED DESCRIPTION

Figure 1:
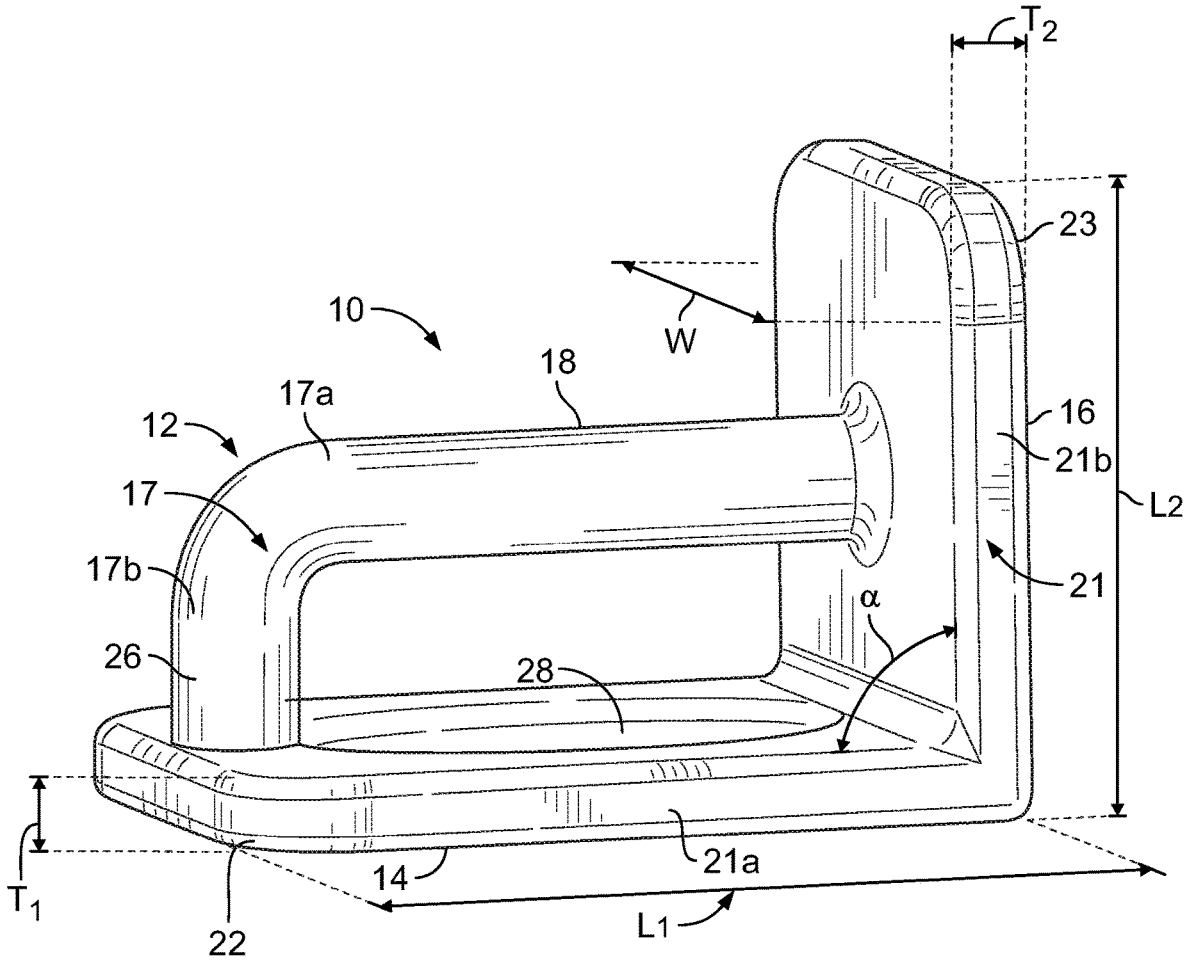
FIG. 1 is a top perspective view of an embodiment of a multi-functional exercise device according to the present invention.

FIG. 1 is a top perspective view of an embodiment of a multi-functional exercise device 10. The exercise device 10 may be used alone or in pairs, according to the user's preference and selected exercise. In various embodiments, the exercise device 10 may be engaged by a user's hands or feet.

The exercise device 10 includes a first planar support member 14 and a second planar support member 16 extending from the first planar support member 14. The exercise device 10 further has a generally L-shaped handle 12 that is joined to the first planar support member 14 and the second planar support member 16, and is adapted to be engaged by a user. From further descriptions, below, and as will otherwise be recognized, handle 12 may also have shapes other than an L.

In the embodiment depicted in FIG. 1, the first planar support member 14 has a length L1 that is greater than a length L2 of the second planar support member 16. It is recognized that in other embodiments, lengths L1 and L2 may be equal, or L1 may be shorter than L2. The first and second planar support members 14, 16 further have thicknesses T1, T2, respectively. In some embodiments, thicknesses T1, T2 may be equal to each other, or one may be thicker than the other. Also, while the width W of support members 14, 16 is depicted only with reference to member 16, is understood to be a constant dimension for both members 14 and 16. It is further recognized that in other embodiments, the width W may vary along lengths L1 and L2, in smooth, jagged fashion or any other fashion, to form any desired shape for members 14, 16 and thus for device 10 as a whole.

The first planar support member 14 is oriented relative to the second planar support member 16 at an angle $\alpha$. While FIG. 1 depicts angle $\alpha$ as being 90°, angle $\alpha$ may also be any acute or obtuse angle, provided it still allows for the overall functionality of the exercise device 10. Such acute angles include, but are not limited to, 60°, 75° and 80°, while such obtuse angles include, but are not limited to 110°, 120°, 135° and 150°.

Handle 12 comprises an elongated gripping portion 18 that contacts the second planar support member 16 at one end, a support portion 26 that contacts the first planar support member 14 at the other end, and a curved connecting portion 17 that extends between the gripping portion 18 and the support portion 26 from curved connecting portion's 17 first end 17*a* to its second end 17*b*. As shown in FIGS. 1-4 and 8, the gripping portion 18 extends from the second planar support member 16 to the first end 17*a* of the connecting joint 17, and is oriented generally parallel to the first planar support member 14 and generally perpendicular to the second planar support member 16. The support portion 26 extends from the first planar support member 14 to the second end 17*b* of the connecting joint 17, and is oriented generally perpendicular to the first planar support member 14 and generally parallel to the second planar support member 16. In this embodiment, the gripping portion 18 and support portion 26 are generally perpendicular to each other. In other embodiments, the gripping portion 18 and support portion 26 may have other orientations relative to each other and to the first and second planar support members 14, 16. The handle support portion 26 is generally of a sufficient height to provide a comfortable separation between the handle gripping portion 18 and the first planar support member 14 such that a user's hand may grip the gripping portion 18 without contacting the first planar support member 14 during use of the exercise device 10. The height of the handle support portion 26 may be any dimension for this purpose, including up to about 10 inches, or even more in length.

Figure 8:
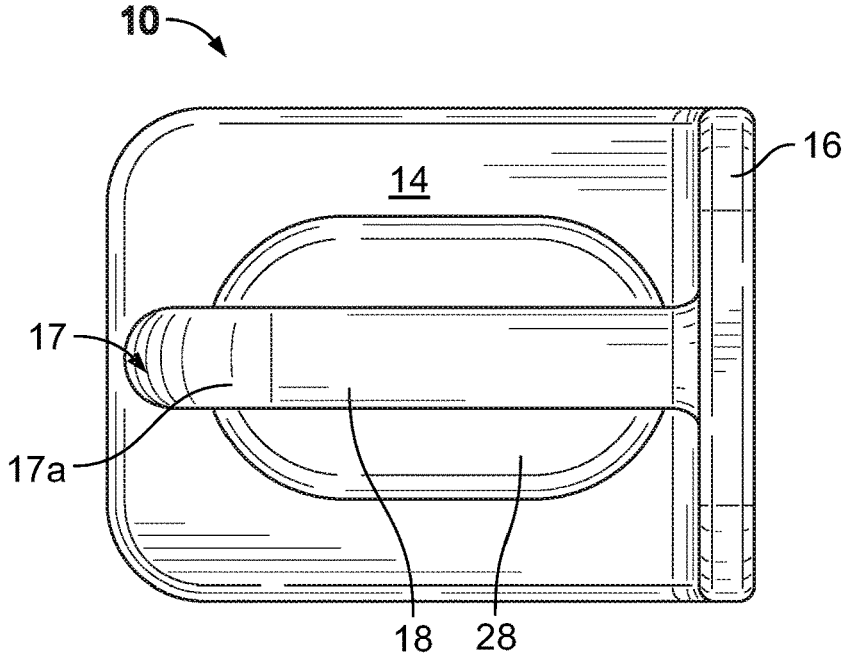
FIG. 8 is a top view of the device of FIG. 1.

As shown in FIGS. 1 and 8, the first planar support member 14 includes a recess 28. In some embodiments, the recess 28 may be formed in any conventional shape known in the art, including, but not limited to, circular, oblong, elliptical or rectangular. In various embodiments, the recess 28 may extend through a portion of the thickness T1 of the first planar support member 14, or all the way through the thickness T1. In either case, and with further reference to FIGS. 2 and 3, the recess 28 provides additional space for a user's U hand (or portion thereof) when holding the gripping portion 18 during use of the exercise device 10. And although not shown, it is readily understood that when the recess extends all the way through the thickness T1, a user U may also insert their hand through the recess 28 in order to grip the gripping portion 18 of the handle 12. As such, it is envisioned that the recess may advantageously be positioned in member 14 and shaped in such a way as to support and cradle the user's U wrist/arm, or alternatively be large enough to not come in contact with it during use of the exercise device 10.

In alternate embodiments, the first planar support member 14 does not include a recess, but nonetheless, the handle support portion 26 is generally of a sufficient height for the use's hand to grip the gripping portion 18 without contacting the first planar support member 14, as discussed above.

Figure 2:
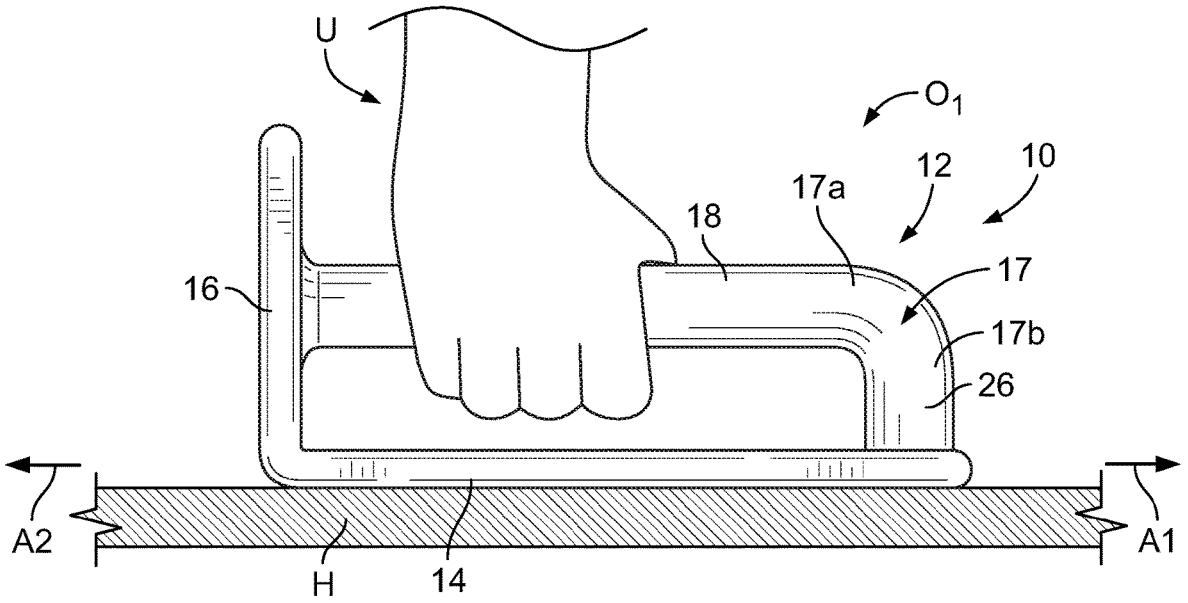
FIG. 2 is a side view of a user employing the device of FIG. 1 in a first orientation.
Figure 3:
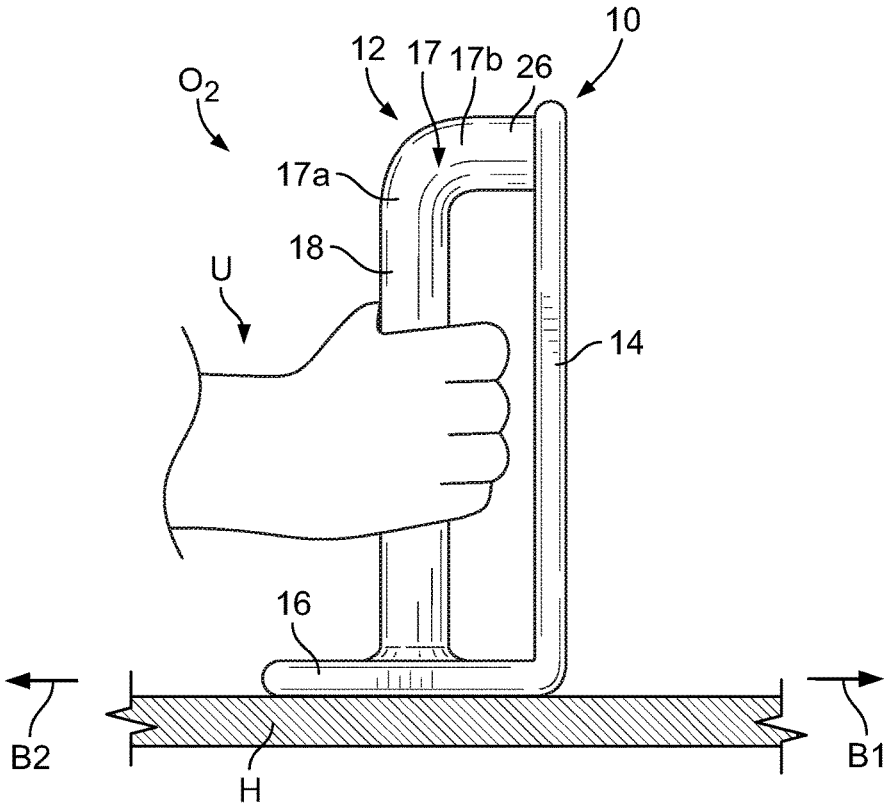
FIG. 3 is a side view of a user employing the device of FIG. 1 in a second orientation.

In an embodiment illustrated in FIGS. 2 and 3, the exercise device 10 is configured for use by a user U against a horizontal surface H (e.g., a floor (bare or covered with a rug or carpet) or a portion of the ground) in at least a first orientation $O_1$ and a second orientation $O_2$. In the first orientation $O_1$, the first planar support member 14 is in contact with the horizontal surface H. In the second orientation $O_2$, the second planar support member 16 is in contact with the horizontal surface H. As is evident, the user U may alternate the exercise device 10, in a variety of different ways, between the first orientation $O_1$ and the second orientation $O_2$. For example, this may be accomplished by rotating the device 10 along surface H so that member 16 loses contact with surface H and member 14 gains contact with surface H. Orientations $O_1$ and $O_2$ allow the user U to exercise certain different muscle groups.

Of course, it is also recognized that the exercise device 10 is usable against a vertical surface (e.g., a wall or door) in different orientations as well. The description of the exercise device 10, its components, and use with a horizontal surface H, is also generally applicable to its use against a vertical surface. More fundamentally, the exercise device 10 is envisioned to be used against virtually any continuous surface, including a round or curved surface.

Figure 4:
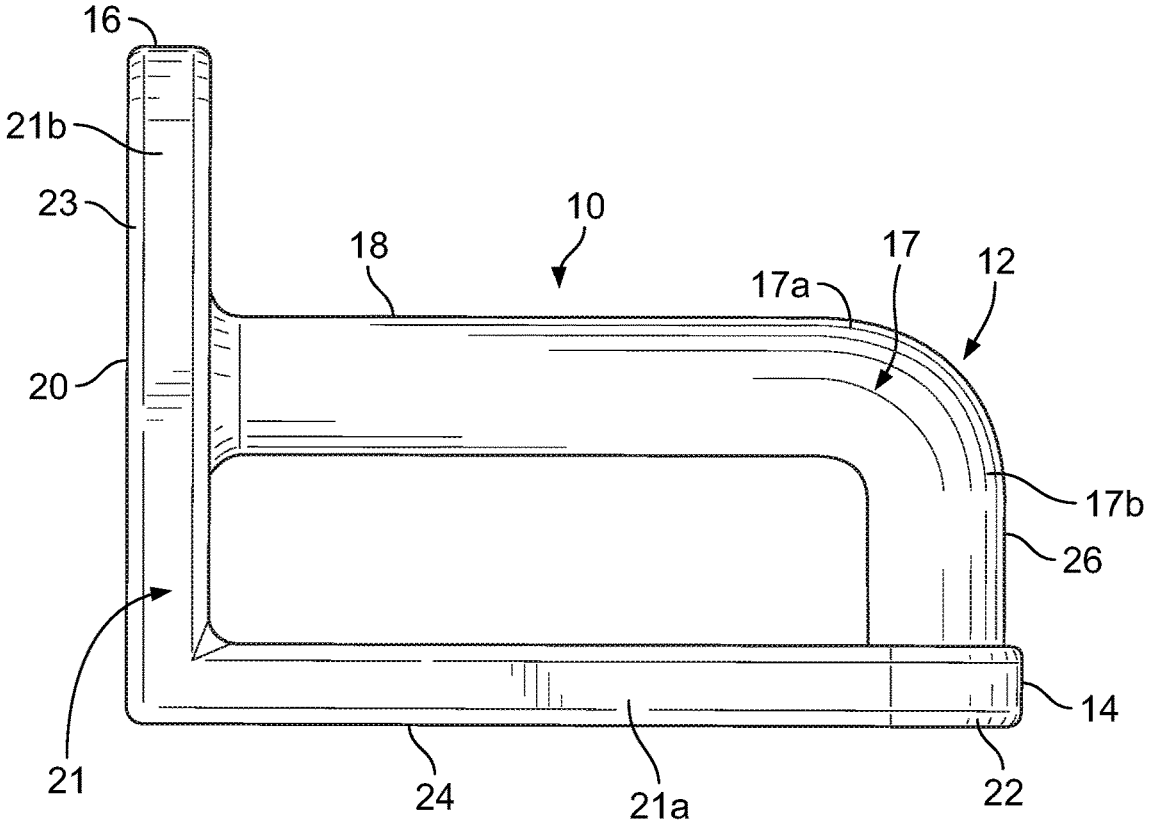
FIG. 4 is a side view of the device of FIG. 1.

FIG. 4 is a side view of the exercise device 10. The exercise device 10 includes a periphery 21 having a first portion 21*a* which extends around the first planar support member 14, and a second portion 21*b* which extends around the second planar support member 16. The first planar support member 14 further includes a first surface-engaging face 24, and the second planar support member 16 includes a second surface-engaging face 20. Faces 20 and 24 are configured and adapted to contact a surface, such as surface H (FIGS. 2, 3). In various embodiments, faces 20, 24 may be configured to help inhibit translation against surface H, while in other embodiments they may be configured to facilitate translation against surface H. For example, to inhibit translation, faces 20, 24 may have a rubberized surface with a high coefficient of friction, or they may be textured. To facilitate translation, faces 20, 24 may have a Teflon surface with a low coefficient of friction. Faces 20, 24 may also have a felt, cloth, synthetic or other covering to facilitate movement over smooth surfaces.

In some embodiments, a first chamfer 22 extends between the first portion 21*a* of the periphery 21 and the first surface-engaging face 24, and a second chamfer 23 extends between the second portion 21*b* of the periphery 21 and the second surface-engaging face 20. First and second chamfers 22, 23 are curved or rounded. In the event when device 10 is moved along surface H, chamfers 22, 24 facilitate smooth movement by reducing the potential for textures, curvatures or other irregularities of surface H to hinder the sliding movement when surface H is in contact with the first or second surface-engaging faces 24, 20. In various embodiments, the chamfers 22, 23 are flat, splined, or curved.

Figure 5:
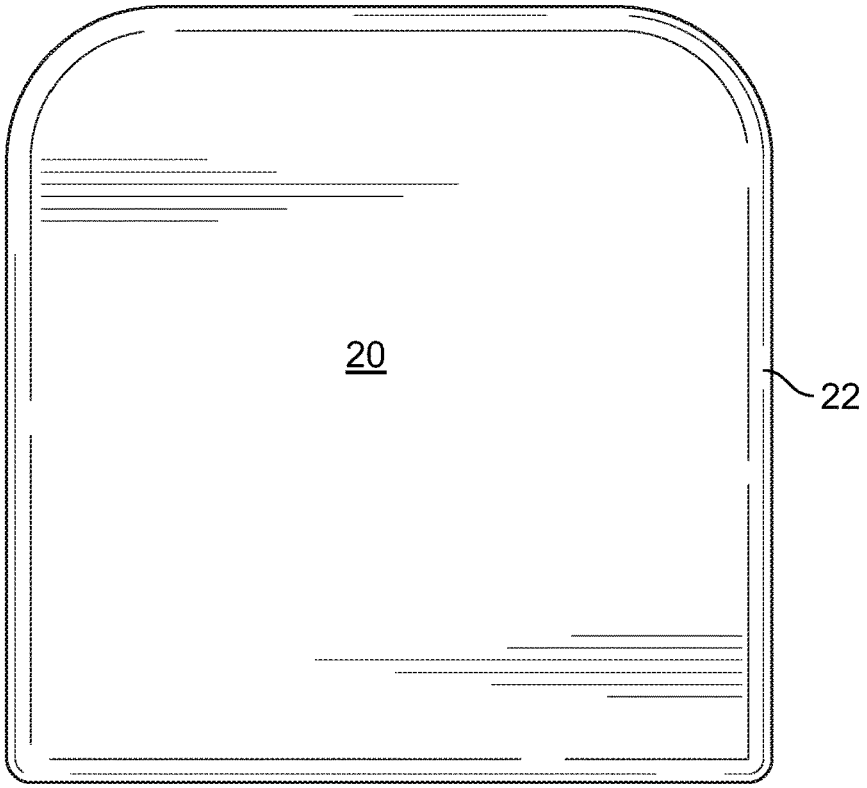
FIG. 5 is a rear view of the device of FIG. 1.
Figure 6:
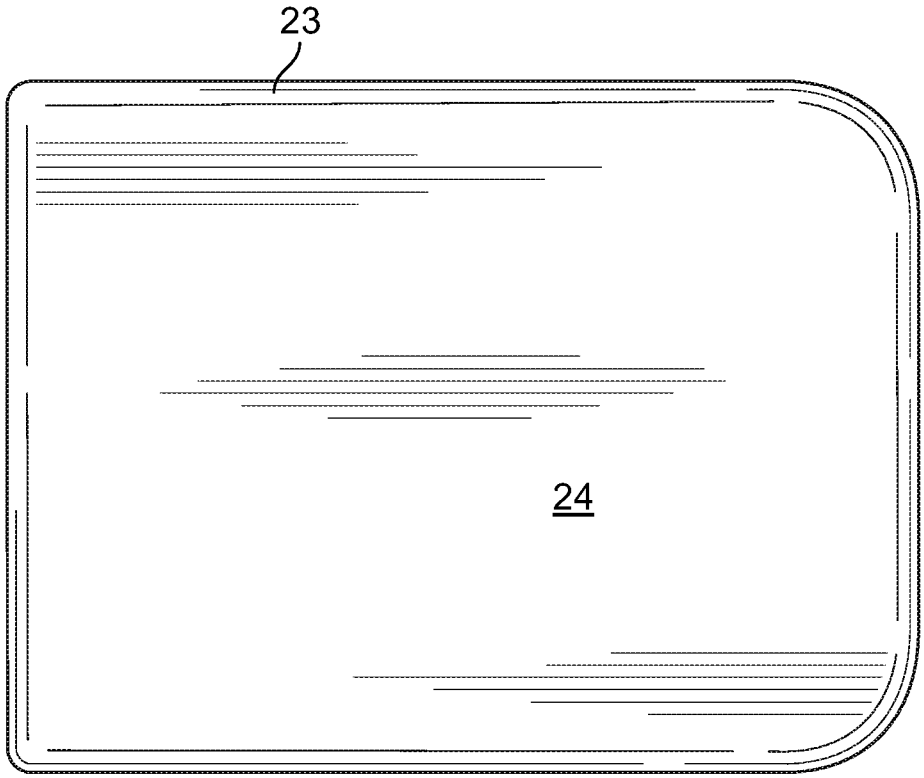
FIG. 6 is a bottom view of the device of FIG. 1.
Figure 7:
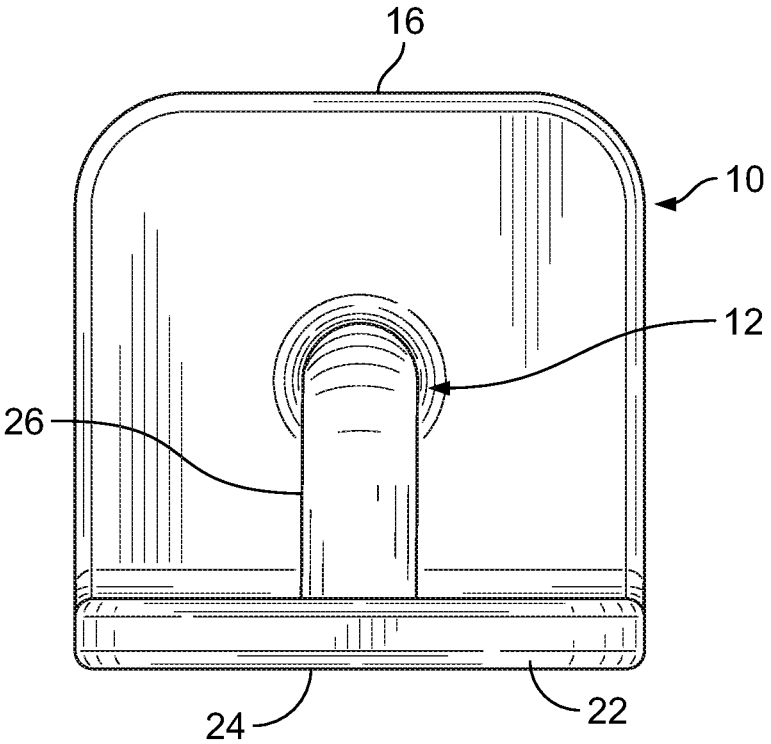
FIG. 7 is a front view of the device of FIG. 1.

As shown in FIG. 5, the second surface-engaging face 20 is smooth and unobstructed, so as to lie evenly on surface H (FIG. 3) during use. FIG. 6 depicts the first surface-engaging face 24, which is also smooth and unobstructed, so as to lie evenly on surface H (FIG. 2) during use. Again, as mentioned earlier, in certain embodiments, the second surface-engaging face 20, the first surface-engaging face 24, or both faces, are provided with a textured and/or rubberized surface (not shown) to increase or decrease friction between the face(s) 20 and/or 24 and the underlying surface H. In some embodiments, the support members 14, 16 are configured to receive either a permanent or removable and interchangeable covering (not shown) that is formed of a material that either increases or decreases the friction between the support members 14, 16 and the underlying surface.

Referring again to FIGS. 2 and 3, in use, a user U places one or a pair of the exercise devices 10 on the horizontal surface H in either the first orientation $O_1$ or second orientation $O_2$. In the first orientation $O_1$ (FIG. 2), the user U grips the gripping portion 18 and supports at least a portion of the user's U weight on the exercise device 10. The user U may initiate various exercise movements, such as push-ups, while trying to maintain device 10 in place. Alternatively, as part of a certain exercise routine, the user U may move the exercise device 10 along the surface H in either a first direction A1, or a second direction A2, or back-and-forth from the first A1 to the second A2 direction, or in any pattern and sequence, including circular motions. Movement of the exercise device 10 in the first orientation $O_1$ exercises a first group of muscles of the user U.

Once the user U has adequately exercised the first group of muscles, the user U may reposition the exercise device 10 from the first orientation $O_1$ (FIG. 2) into the second orientation $O_2$ (FIG. 3) to exercise a second group of muscles. This occurs by virtue of the changed orientation of the user's grip relative to surface H. Again, exercises may be performed while maintaining the exercise device stationary or by and/or in conjunction with moving it. Movement in the second orientation $O_2$ is shown in FIG. 3. The exercise device 10 may be moved along surface H in either a first direction B1, or a second direction B2, or back-and-forth from the first B1 to the second B2 direction, or in any pattern and sequence, including circular motions.

Figure 9:
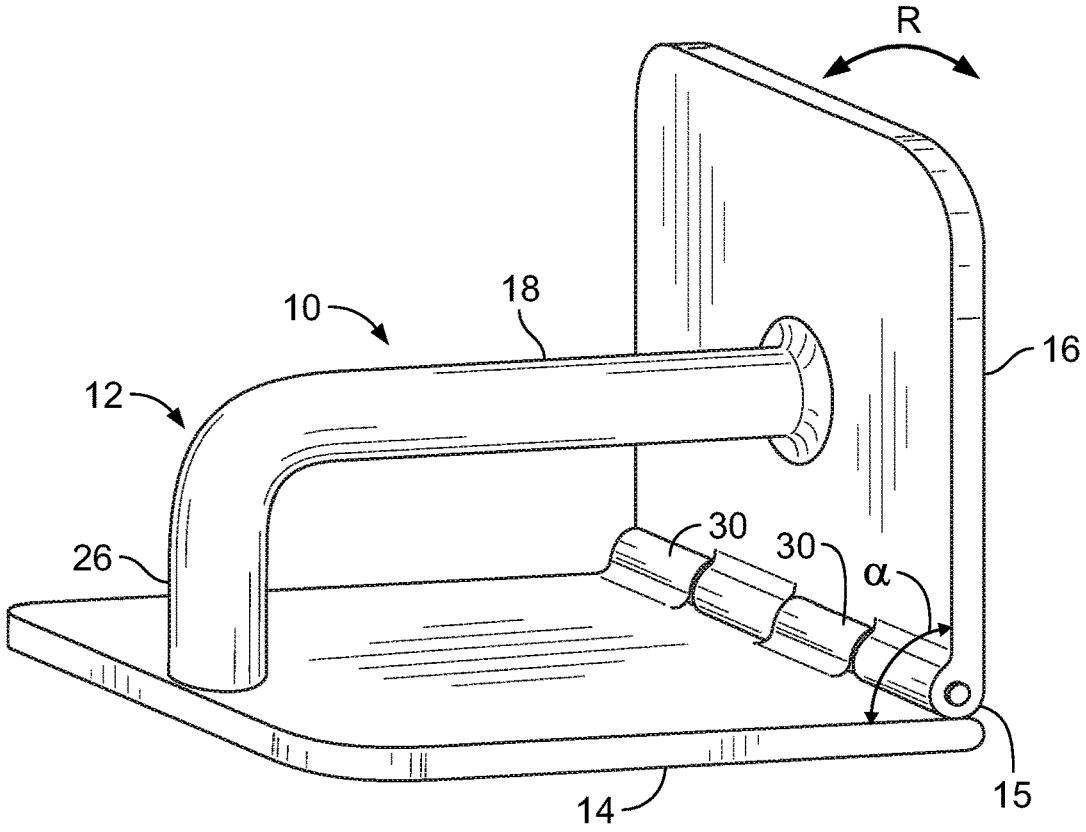
FIG. 9 is a top perspective view of an alternate embodiment of the device of FIG. 1.

FIG. 9 illustrates another embodiment of exercise device 10 wherein the support members 14, 16 are connected by a hinge 30 at a joint 15. Further, while not depicted in detail, handle 10 has the gripping portion 18 formed from two or more segments which may be telescoping or otherwise formed to be longer or shorter, as needed. Handle 10 is also joined to members 14 and 16 at either flexible or rotatable joints. Either one or more of the joints, handle 10, or hinge 30 further have the capacity to be locked in place. This can be achieved in a variety of ways as is well known to those skilled in the art. The combination of these elements in the embodiment of FIG. 9 facilitate configuring member 16 at different angles $\alpha$ relative to member 14 through movement in direction R, and then locking the two members 14, 16 in place relative to each other. This enables a user U to reconfigure exercise device 10 into different angles $\alpha$ other than 90 degrees. In use, other angles $\alpha$ result in different muscles of the user U being used, and/or a change in forces being exerted on the same muscles, during a particular exercise routine with device 10.

Figure 10:
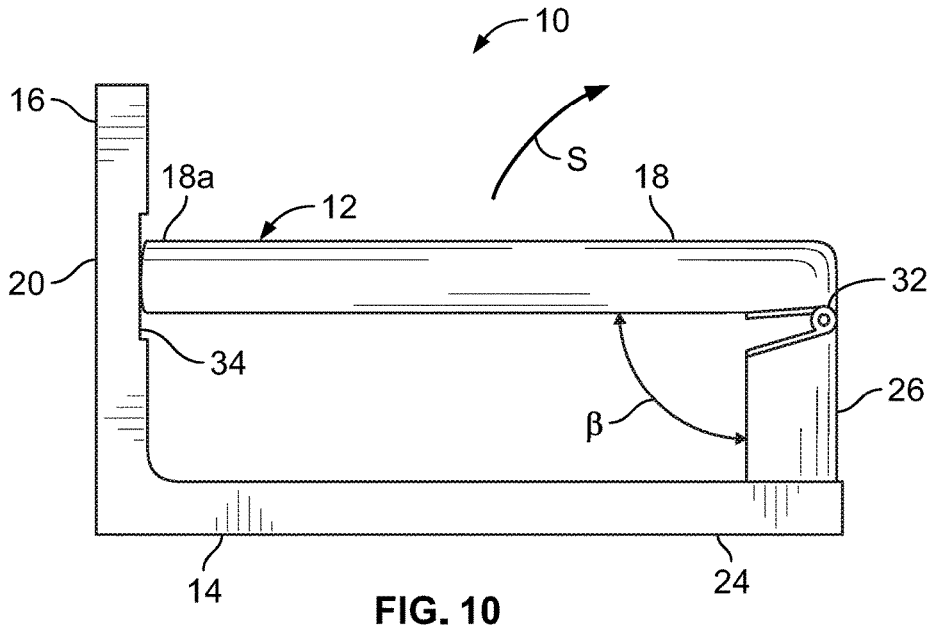
FIG. 10 is a side schematic view of an alternate embodiment of the device of FIG. 1.

FIG. 10 depicts another embodiment of the invention wherein the support portion 26 and gripping portion 18 of the handle 12 are joined by a hinge 32. As discussed above with respect to hinge 30, hinge 32 is also lockable, as is known in the art. Replacing the curved connecting portion 17 of handle 10 with hinge 32 enables the user to change angle $\beta$ between the support portion 26 and gripping portion 18 of the handle 12 by rotating the gripping portion 18 towards or away from the first planar support member 14, as indicated by arrow S, and then locking it in place. As is understood relative to the embodiment depicted in FIG. 9, this is another way of altering the orientation of the gripping portion 18 of handle 12 relative to members 14 and 16.

Optionally, to limit the range of settings for angle $\beta$, a track 34 is provided on member 16 in which the end 18*a* of the gripping portion 18 of the handle 12 may travel when a user U is setting angle $\beta$. Track 34 is configured such that end 18*a* can travel along and inside the track but not out of the track. Again, gripping portion 18 may be a fixed length or of modular construction.

In various embodiments, some of which may not have track 34, angle $\beta$ can be either obtuse (greater than 90° but less than 180°) or acute (greater than 0° but less than 90°). In some embodiments, angle $\beta$ is between 45° and 90°, while in other embodiments, angle $\beta$ is between 90° and 135°. As discussed in connection with the embodiment of FIG. 9, such functionality further increases the exercise device's 10 range of use.

In still other embodiments, different lockable and non-lockable joints and surface features to control motion, at different locations on device 10, may be employed to enable adjustment of handle 12 and/or gripping portion 18, relative to one or both of members 14 and 16. For example, a ball-and-socket joint or a gimbaled connection (not shown) may be used between handle 12 and member 16, as would be readily known to those skilled in the art.

Figure 11:
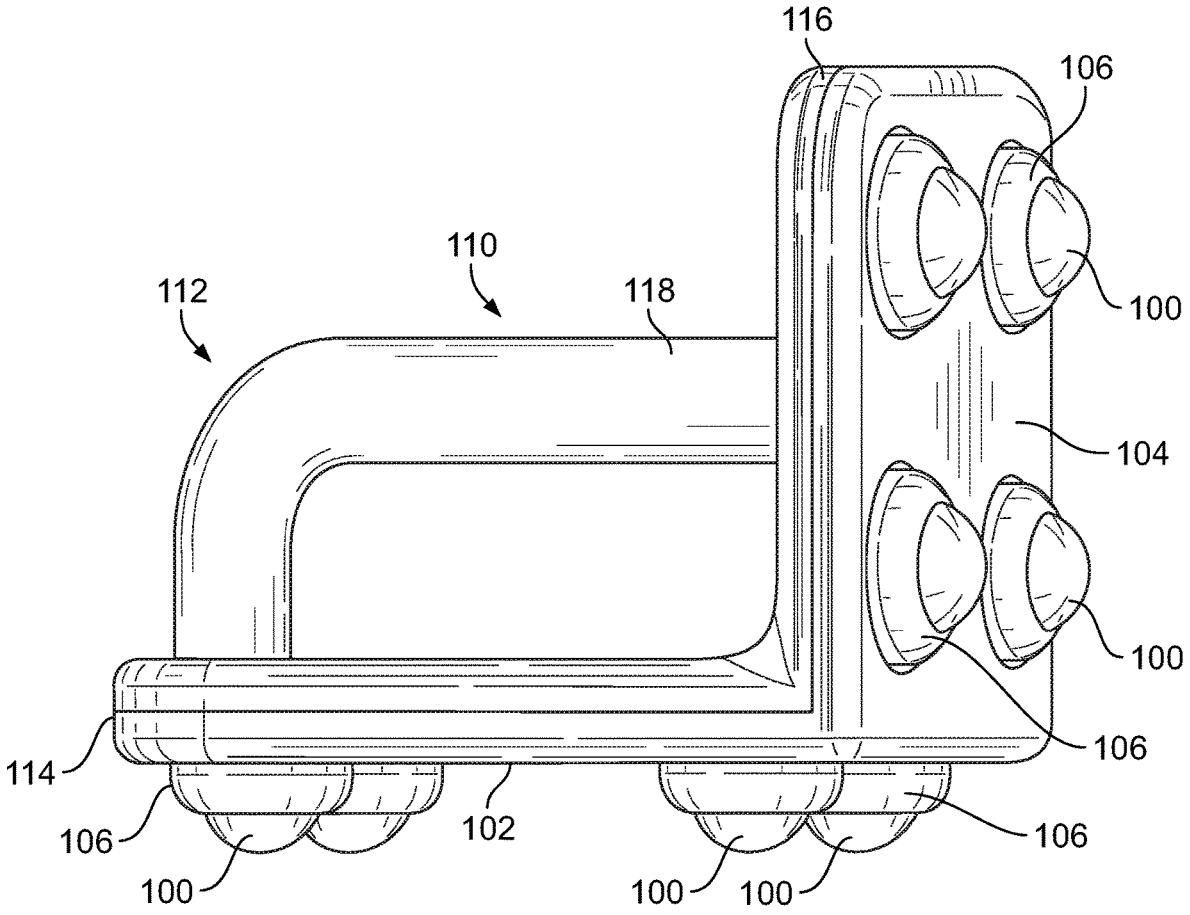
FIG. 11 is a bottom perspective view of an alternate embodiment of a multi-functional exercise device according to the present invention.
Figure 12:
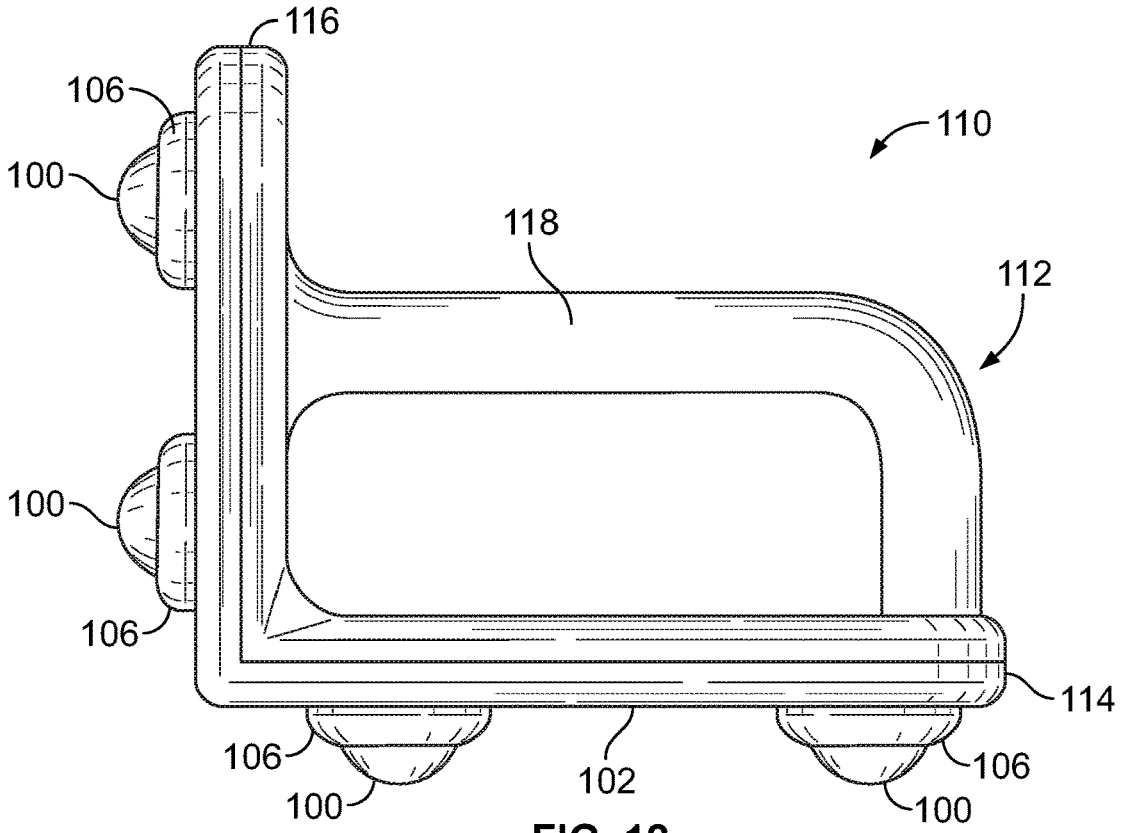
FIG. 12 is a side view of the device of FIG. 11.
Figure 13:
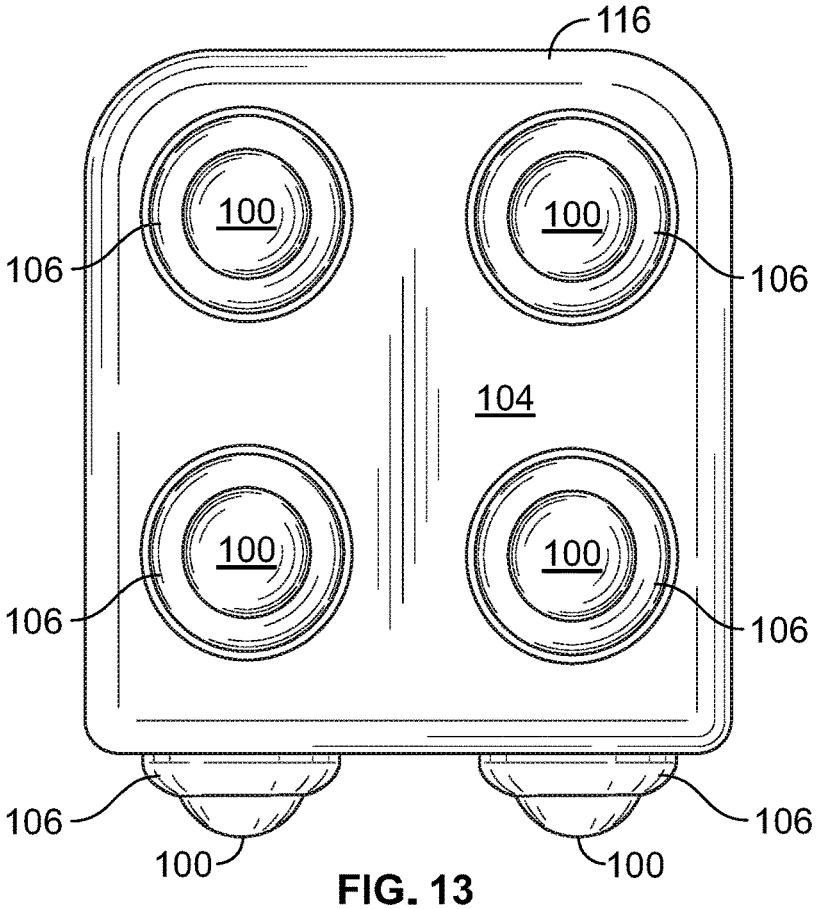
FIG. 13 is a rear view of the device of FIG. 11.

With reference to FIGS. 11-13, an alternate embodiment of the present invention is depicted. Elements depicted in FIGS. 11-13, which are similar to elements depicted in FIGS. 1-8 will be given a similar reference number plus 100.

Continuing to refer to FIGS. 11-13, an exercise device 110 includes rotatable, and optionally lockable, components to facilitate engagement with a surface. In the depicted embodiment, the rotatable components are one or more spheres 100. The rotatable components may be generally cylindrical, ellipsoidal, toroidal, or any other shape known in the art as being capable of rotating.

In an embodiment, a first mounting plate 102 engages the first planar support member 114 to retain a first plurality of spheres 100 adjacent the first planar support member 114. Similarly, a second mounting plate 104 engages the second planar support member 116 to retain a second plurality of spheres 100 adjacent the second planar support member 116. Each mounting plate 102, 104 has a plurality of spherical retainers 106 adapted to maintain spheres 100 in their locations and allow them to freely rotate relative to the planar support members 114, 116.

In other embodiments, the mounting plates 102, 104 are omitted and the planar support members 114, 116 are otherwise configured to retain the plurality of spheres 100, as is recognized in the art. Various other embodiments include one or more tensioning mechanisms that increase the amount of force needed to make spheres 100 rotate, up to the point of locking spheres 100 in place and preventing rotation. In yet other embodiments, the rotatable components may be commonly known rollers or other devices, and may be affixed directly to planar support members 114, 116 in any quantity and at any number of locations.

One of skill in the art will understand that the plurality of spheres 100 described above will permit the exercise device 110 to move in any direction along a surface. In an embodiment, the plurality of spheres 100 described above are replaced by semi-constrained wheels that permit the exercise device 110 to move freely in only one direction. In other embodiments, castors or other devices known in the art are employed to facilitate controlled movement of the exercise device 110 while in use. In various embodiments, combinations of spheres, wheels, castors, and other devices are used. As described before in relation to a different embodiment, the friction on the wheel or castor axle may be increased to increase the resistance to movement of the exercise device 110. The friction on the wheel or castor axle may be increased in a variety of ways known in the art, such as by tightening a flange around the axle or by applying a brake by known methods.

In various embodiments, a first plurality of the rotating components is adapted to generate a first resistance to movement of the exercise device in a first configuration, and a second resistance to movement of the exercise device in a second configuration, wherein the force necessary to overcome the first resistance is different from that necessary to overcome the second resistance.

Further, the handle 112, and its connections to the planar support members 114, 116 may be modified as discussed above with reference to handle 12. Similarly, planar support members 114, 116 may be modified as discussed above with reference to planar support members 14, 16.

Other embodiments of the invention will be apparent to those skilled in the art from consideration of the specification and practice of the invention disclosed herein. It is intended that the embodiments described above be considered as exemplary only, with a true scope and spirit of the invention being indicated by the appended claims. Moreover, none of the features disclosed in this specification should be construed as essential elements, and therefore, no disclosed features should be construed as being part of the claimed invention unless the features are specifically recited in the claims. It will be understood that any of the features disclosed on any particular embodiment may be incorporated in whole or in part on any of the other disclosed embodiments.

What is claimed is:

1. An exercise device comprising:

a first planar support member;

a second planar support member extending generally perpendicularly from said first planar support member;

a handle having a first end coupled to said first planar support member, a second end coupled to said second planar support member, and a gripping portion therebetween, said gripping portion oriented generally parallel to said first planar support member and generally perpendicular to said second planar support member;

a first plurality of rotatable components engaging said first planar support member and adapted to rotate relative thereto; and a second plurality of rotatable components engaging said second planar support member and adapted to rotate relative thereto.

2. The exercise device of claim 1, further comprising a first mounting plate that retains said first plurality of rotatable components against said first planar support member, and a second mounting plate that retains said second plurality of rotatable components against said second planar support member.

3. The exercise device of claim 2, wherein said first and second mounting plates each include a plurality of spherical retainers adapted to respectively maintain said first and second plurality of rotatable components in their locations while respectively allowing said first and second plurality of rotatable components to rotate.

4. The exercise device of claim 1, wherein said first plurality of rotatable components comprise spheres, and wherein said second plurality of rotatable components comprise spheres.

5. The exercise device of claim 1, wherein said gripping portion contacts said second planar support member at said second end of said handle, and wherein said handle further includes a support portion that contacts said first planar support member at said first end of said handle and a curved connecting portion that extends between said gripping portion and said support portion.

6. The exercise device of claim 1, wherein said first planar support member further comprises a thickness and a recess in said thickness.

7. The exercise device of claim 6, wherein said recess extends completely through said thickness.

8. An exercise device comprising:

a first planar support member having a first plurality of rotatable components adapted to rotate relative to the first planar support member;

a second planar support member extending from said first planar support member at an angle alpha therebetween and having a second plurality of rotatable components adapted to rotate relative to the second planar support member; and a handle coupled to said first planar support member and to said second planar support member, said handle having an elongated gripping portion that contacts said second planar support member at a first end of said handle, a support portion that contacts said first planar support member at a second end of said handle, and a curved connecting portion that extends between said elongated gripping portion and said support portion;

wherein said elongated gripping portion is oriented generally parallel to said first planar support member and generally perpendicular to said second planar support member; and wherein said exercise device is configured to be alternated between a first orientation in which said first plurality of rotatable components are positioned against a surface, and a second orientation in which said second plurality of rotatable components are positioned against the surface.

9. The exercise device of claim 8, further comprising a first mounting plate that retains said first plurality of rotatable components against said first planar support member, and a second mounting plate that retains said second plurality of rotatable components against said second planar support member;

wherein said first and second mounting plates each include a plurality of spherical retainers adapted to respectively maintain said first and second plurality of rotatable components in their locations while respectively allowing said first and second plurality of rotatable components to rotate.

10. The exercise device of claim 8, wherein said first plurality of rotatable components comprise spheres, and wherein said second plurality of rotatable components comprise spheres.

11. The exercise device of claim 8, wherein said angle alpha is approximately 90 degrees such that said first planar support member and said second planar support member are oriented generally perpendicular to each other.

12. The exercise device of claim 8, wherein said first planar support member further comprises a thickness and a recess in said thickness.

13. The exercise device of claim 12, wherein said recess extends completely through said thickness.

14. An exercise device comprising:

a first planar support member adapted to engage a surface in a first orientation via a first plurality of rotatable components;

a second planar support member extending from said first planar support member at an angle alpha therebetween, and adapted to engage the surface in a second orientation via a second plurality of rotatable components;

said first plurality of rotatable components engaging said first planar support member and adapted to rotate relative thereto;

said second plurality of rotatable components engaging said second planar support member and adapted to rotate relative thereto;

a handle coupled to said first planar support member and to said second planar support member, said handle having an elongated gripping portion that contacts said second planar support member at a first end of said handle, a support portion that contacts said first planar support member at a second end of said handle, and a curved connecting portion that extends between said elongated gripping portion and said support portion;

wherein said exercise device further comprises a periphery that extends around said first planar support member and said second planar support member; and wherein said first planar support member includes a first chamfer that extends around said periphery.

15. The exercise device of claim 14, wherein said second planar support member includes a second chamfer that extends around said periphery.

16. The exercise device of claim 14, wherein said elongated gripping portion of said handle is oriented generally parallel to said first planar support member and generally perpendicular to said second planar support member.

17. The exercise device of claim 14, further comprising a first mounting plate that retains said first plurality of rotatable components against said first planar support member, and a second mounting plate that retains said second plurality of rotatable components against said second planar support member.

18. The exercise device of claim 17, wherein said first and second mounting plates each include a plurality of spherical retainers adapted to respectively maintain said first and second plurality of rotatable components in their locations while respectively allowing said first and second plurality of rotatable components to rotate.

19. The exercise device of claim 14, wherein said first plurality of rotatable components comprise spheres, and wherein said second plurality of rotatable components comprise spheres.

20. The exercise device of claim 14, wherein said first planar support member further comprises a thickness and a recess extending completely through said thickness.

* * * * *